US005771801A

United States Patent [19]

Newman et al.

[11] Patent Number: 5,771,801

[45] Date of Patent: Jun. 30, 1998

[54] FRONT HEAD FOR CAROUSEL SCREEN PRINTING MACHINE

[75] Inventors: Don E. Newman, Wyncote, Pa.; Thomas A. McKeever, Maple Shade, N.J.

[73] Assignee: Stretch Devices, Inc., Philadelphia, Pa.

[21] Appl. No.: 547,857

[22] Filed: Oct. 25, 1995

[51] Int. Cl.[6] ..... B41F 15/36

[52] U.S. Cl. ..... 101/127.1; 101/DIG. 36; 101/129

[58] Field of Search ..... 101/DIG. 36, 114, 101/126, 127, 127.1, 129, 481, 485, 486; 33/614, 615, 616, 617, 620, 621

[56] References Cited

U.S. PATENT DOCUMENTS

| | | | |
|---|---|---|---|
| 3,098,431 | 7/1963 | Weaver | 33/614 |
| 4,641,577 | 2/1987 | Sweeny | 101/415.1 |
| 4,972,773 | 11/1990 | Barlow | 101/127.1 |
| 5,161,460 | 11/1992 | Andersen et al. | 101/127.1 |
| 5,188,026 | 2/1993 | Fuqua et al. | 101/126 |
| 5,315,929 | 5/1994 | Sundqvist | 101/127.1 |
| 5,377,422 | 1/1995 | Newman | 33/620 |
| 5,445,075 | 8/1995 | Panipinto | 101/127.1 |
| 5,522,148 | 6/1996 | Newman | 33/620 |

OTHER PUBLICATIONS

Brochure from M&R Printing Equipment Inc. entitled "World Class Manufacturer Of Screen Printing Equipment For Graphic And Textile Applications".

*Primary Examiner*—Ren Yan

*Attorney, Agent, or Firm*—Seidel, Gonda, Lavorgna & Monaco, P.C.

[57] ABSTRACT

An apparatus for securing a screen printing frame to a printing machine for screen printing, the apparatus has a retainer for the screen printing frame and a mounting head carried by the printing machine. A plurality of adjustment mechanism are interposed between the mounting head and the retainer for screen printing frame for adjusting the retainer and the screen printing frame relative to the mounting head. At least one of the adjustment mechanisms has a sleeve having a threaded bore carried by either the retainer or the mounting head and a threaded shaft carried by the other. Rotating of the threaded shaft in the threaded bore adjust the position of the screen printing frame relative to the mounting head. The sleeve has a hole extending through the threaded bore and a pin adaptable for insertion in the hole for locating the end of the threaded shaft for use as a stop position for locating a zero position of the adjustment mechanism. The threaded shaft is adjustable positioned on the other of the retainer or the mounting head for adjusting the stop therein adjusting the zero position of the adjustment mechanism.

31 Claims, 10 Drawing Sheets

FRONT HEAD FOR CAROUSEL SCREEN PRINTING MACHINE

FIELD OF THE INVENTION

This invention relates to a registration system for a screen printing frame and screen mesh and more particularly to a head for receiving the screen printing frame for screen printing.

BACKGROUND OF THE INVENTION

In the majority of screen printing operations, more than one color is used to create the desired image on a substrate. The use of more than one color results in using several screen frames each with a screen mesh. Each screen frame has a screen mesh, one for each color, wherein each screen mesh has the associated image for that color. It is therefore necessary to ensure that the image from each screen is positioned properly with the substrate, so that each associated color aligned properly on the substrate when printed.

One of the conventional ways of aligning the images is to place the image on the screen mesh in the screen frame, and mount the screen frame in a clamp in a printing machine. The screen frame is adjusted relative to the clamp; the clamp of the printing machine is adjusted relative to the image pallet which receives the substrate. Typically, the image on the screen mesh was adjusted relative to the image platform by comparing by eye the image on the screen image to a image mounted to the image pallet (platform). After this gross adjustment, test prints would take place to allow for fine adjustment.

Depending on the type of machine, the adjustment of all the screen frames would be done before beginning production run or before that individual color. Two common style machines are a carousel machine and a flat bed graphics machine. The carousel machine has a plurality of print stations each having a clamp for holding the screen frame above an image pallet. The clamps and pallets rotate relative to each other and move vertically relative to each other such that a substrate on the image pallet aligns with each of the images on the screen. The printing of the second and successive colors is typically done on wet ink of the previous colors for textile printing. This machine can be used also for graphics, wherein the substrate is dried between interposed stations in graphics work.

The flat bed graphics machine has a single frame mounting location. One color, image, is printed on the entire run of substrates before another color is used, or alternatively additional machines are used for additional colors. The substrate, such as a poster, is cured, typically by heat, between colors.

The invention is described in the detailed description in context with a carousel machine. Therefore the remainder of the background will describe carousel machines. It is recognized that some of the features of the invention are applicable to other style screen printing machines, including graphics machine.

In manual carousel machines, the typical configuration is that the screen frame is held at one end by a "C" shaped clamp. The "C" shaped clamp with the screen frame rotates in a circular motion above the pallet, image platform, holding the substrate. The screen frames pivot downward into position over the pallet for printing.

Typically on automatic machines, the screen frame is held by a pair of "C" shaped clamps. The pallet with the substrate is rotated around under the "C" shaped clamps with the screen frames. The pallet with the substrate moves upward in a translational movement into proximity to the "C" shaped clamps with the screen frames, so that the squeegee can transfer ink to the substrate.

In attempt to increase production by decreasing the time required to align the images it is recognized that it is desirable to have an easy method to align the screen printing frame with the "C" shaped clamp. In order to help in registering the screen frame, the frame can have holes or slots which accept pins located in the "C" shaped clamps, or other suitable method. U.S. Pat. No. 5,377,422 discloses a pin registration system for roller frames, and is incorporated herein by reference.

While the two "C" shaped clamps on an automatic carousel machine holds the screen frame more securely than the single "C" shaped clamp on the manual machine, the two "C" shaped clamps make it difficult to install the screen frame into the machine. (The reasons for two "C" shaped clamps is because of the additional vibration associated with the increased speed of an automatic carousel machine.) Because of the installation difficulties, one of the "C" shaped clamps on the automatic machine is a part of a front head, which is pivotably mounted for moving out of the way to install the screen.

Once the screen frame is generally in position, the front head is pivoted down and the "C" shaped clamp is secured to the screen printing frame. The rear "C" shaped clamp is secured to the screen printing frame.

Several shortcoming of the present method are that the front head flexes as the machine prints therein moving the screen frame, and there is no method of quickly aligning the screen frames into a position which is close to the ulitmate registration position.

It is desired to have an improved head for improved and consistent registration of the screen frame in the printing machine.

SUMMARY OF THE INVENTION

The invention resides in an apparatus for securing a screen printing frame to a printing machine for screen printing. The apparatus has a retainer for the screen printing frame and a mounting head carried by the printing machine. A plurality of adjustment mechanism are interposed between the mounting head and the retainer for the screen printing frame for adjusting the retainer and the screen printing frame relative to the mounting head. At least one of the adjustment mechanisms has a stop position for locating a zero position of the adjustment mechanism.

One object, feature and advantage resides in the stop position associated with the adjustment mechanisms, for setting the positions of the retainer and the screen printing frame relative to the mounting head carried by the printing machine to a designated zero position. With the zero setting apparatus, the operator can quickly align the screen frames into a position which is close to the ultimate registration position.

In a preferred embodiment, the adjustment mechanism has a sleeve having a threaded bore carried by either the retainer or the mounting head and a threaded shaft carried by the other. Rotating of the threaded shaft in the threaded bore adjust the position of the screen printing frame relative to the mounting head. The sleeve has a hole extending through the threaded bore and a pin adaptable for insertion in the hole for locating the end of the threaded shaft for use as a stop position for locating a zero position of the adjustment mechanism. The threaded shaft is adjustably positioned on the other end of the screen retainer or the mounting head for adjusting the stop, therein adjusting the zero position of the adjustment mechanism.

In a preferred embodiment, the apparatus has a beam extending along a longitudinal axis of the apparatus. The beam has a head at one end, and the head has a stop. The head has a frame having an apex and a base. The frame is pivotably mounted at its apex to beam for pivoting the head between an open raised position and a closed lowered position. The first slideable plate is carried by the base of the frame. The second slideable plate is slideably located on the first plate. The adjustment mechanisms connect the first plate to the second plate for adjustably moving the second plate relative to the first plate.

One object, feature, and advantage resides in a head stop engaging lip carried by the "A" frame having a slot, and a shaft extending from a head stop having a shaft adapted to be received by the slot and a threaded portion adapted to receive a tightening device, wherein the tightening device moves on the shaft for engaging the head stop engaging lip for retaining the front head in the closed lowered position without creating lateral movement on the head resulting in misalignment.

In a preferred embodiment, the apparatus has a plurality of position indicators mounted on one of the plates for gauging the position of the other plate. The operator is therefore able to determine from examining the test image how far to adjust the head and through the position indicators to determine when the adjustment has been made, therefore reducing the number of test images.

In a preferred embodiment, the apparatus has a pair of springs extending between the beam and the "A" frame to retain the head in both the open raised position and the closed lowered position. An object, feature, and advantage of the present invention resides in the springs ensuring the head is held securely in both positions, and in addition allowing the operator to move the head from the open raised position without having to perform a releasing operation.

Further objects, features, and advantages of the present invention will become more apparent to those skilled in the art as the nature of the invention is better understood from the accompanying drawings and detailed descriptions.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 17 is an enlarged top view of FIG. 14 with the

DETAILED DESCRIPTION OF THE INVENTION

Figure 1:
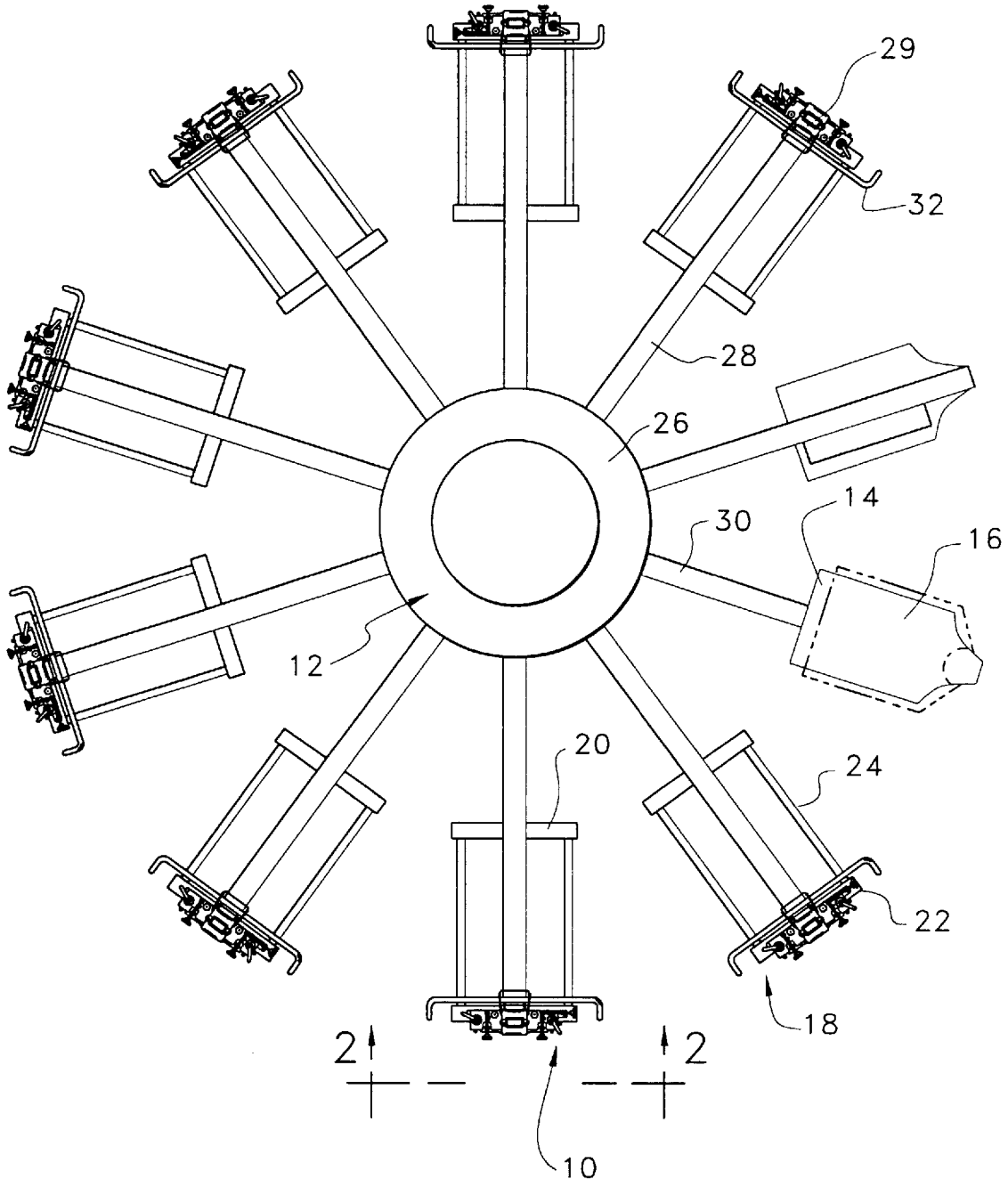
FIG. 1 is a top view of a eight station carousel automatic printing machine having a front head according to the invention.

Referring to the drawings in detail, where like numerals indicate like elements, there is illustrated a device in accordance with the present invention designated generally as 10.

Referring to FIG. 1, a carousel printing machine 12 has ten pallets 14 for receiving a substrate 16, such as a shirt shown in phantom, to be printed on and eight print stations 18. It is recognized that the number of print stations could range upwards from two and generally is between four and twelve. The number of print stations and pallets is not relevant to the invention.

Each print station 18 has a rear "C" shaped channel 20 and a front "C" shaped channel 22 for accepting a screen printing frame 24. The pallets 14 rotate such that the pallets 14 move under each of the printing stations 18. When the pallets 14 are positioned under the printing stations 18, the pallets 14 are moved upward, vertically out of the page as viewed in FIG. 1, in close proximity to the respective screen printing frame for allowing transfer of ink to the substrate.

Both the pallets 14 and the printing stations 18 are cantilevered from a central hub 26 of the carousel printing machine 12. The front head 10 of each printing station 18 is mounted to an arm or beam 28 at the cantilevered end 29. Each pallet 14 is mounted at the cantilevered end of an arm 30. Each arm 28 and 30 extends radially from the central hub 26 in this machine. (In that the style of the machine is not relevant and larger machines may be of an oval or "L" shape, for ease of discussion, the arm 28 is defined as a longitudinal axis.) The carousel printing machine 12 shown in FIG. 1 has stiffening bars 32 which support the cantilever end 29 of the printing station arm 28.

Figure 2:
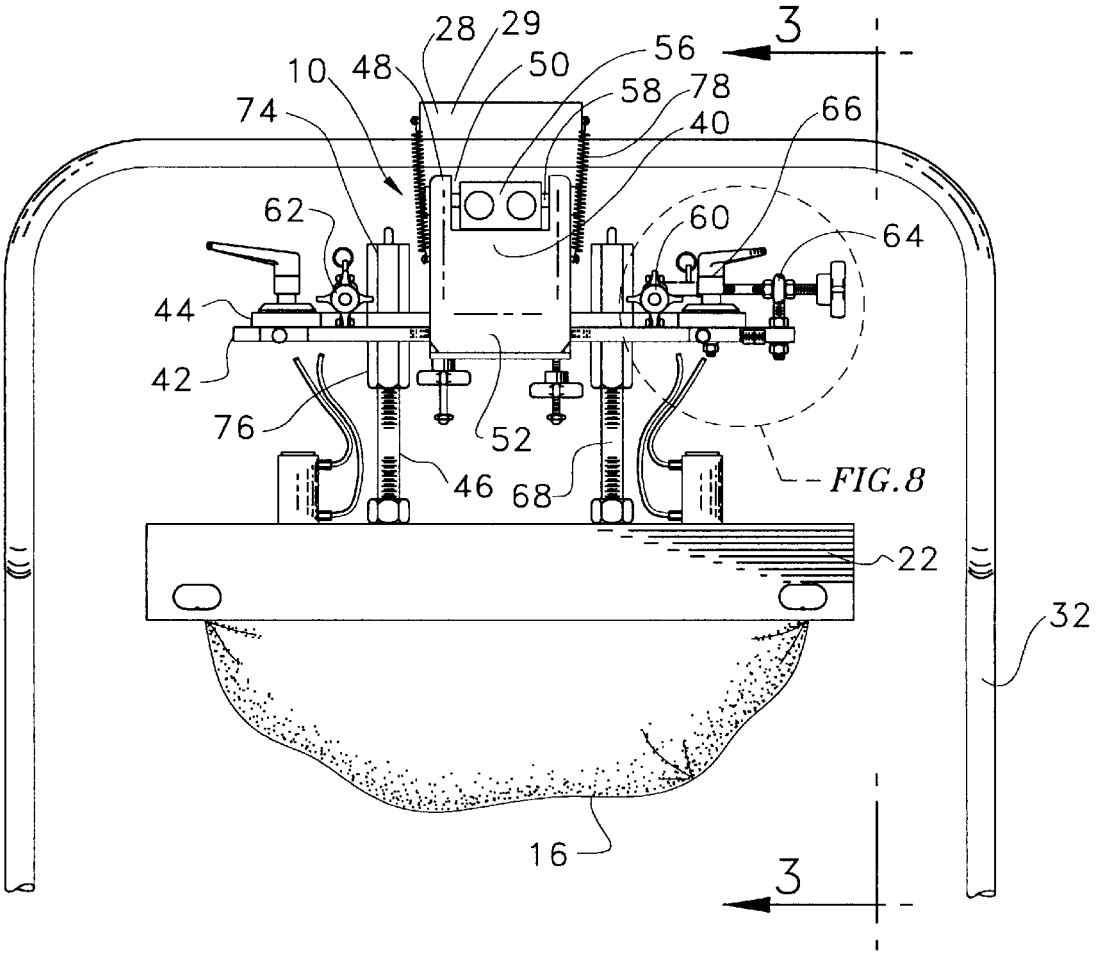
FIG. 2 is a front view of a printing station having the front head according to the invention taken along line 2—2 of FIG. 1.

Each of the printing stations has an identical front head 10, thus only one will be discussed. Referring to FIG. 2, the front head 10 has an "A" shaped support 40, a lower sliding plate 42, an upper sliding plate 44, and a pair of depending threaded bars 46. The "A" shaped support 40 of the front head 10 has an apex 48, through which a groove 50 is cut, and a base 52. The "A" shaped support is pivotally mounted at the apex 48 to a lower projection 56 of the arm 28 by a pair of bolts 58. The groove 50 of the "A" shaped support 40 is wider than the lower projection 56 of the arm 28 to allow for adjustment as described below.

The lower sliding plate 42 is secured to the base 52 of the "A" shaped support 40. The upper sliding plate 44 is slideably located on top of the lower sliding plate 42. Interposed between the two sliding plates 42 and 44 is a triplet of adjustment mechanisms 60, 62, and 64. In addition, there are a pair of locking mechanisms 66 for securing the slidable plates in relative position. The adjustment mechanisms 60, 62 and 64 and the locking mechanism 66 are discussed in further detail below.

Figure 9:
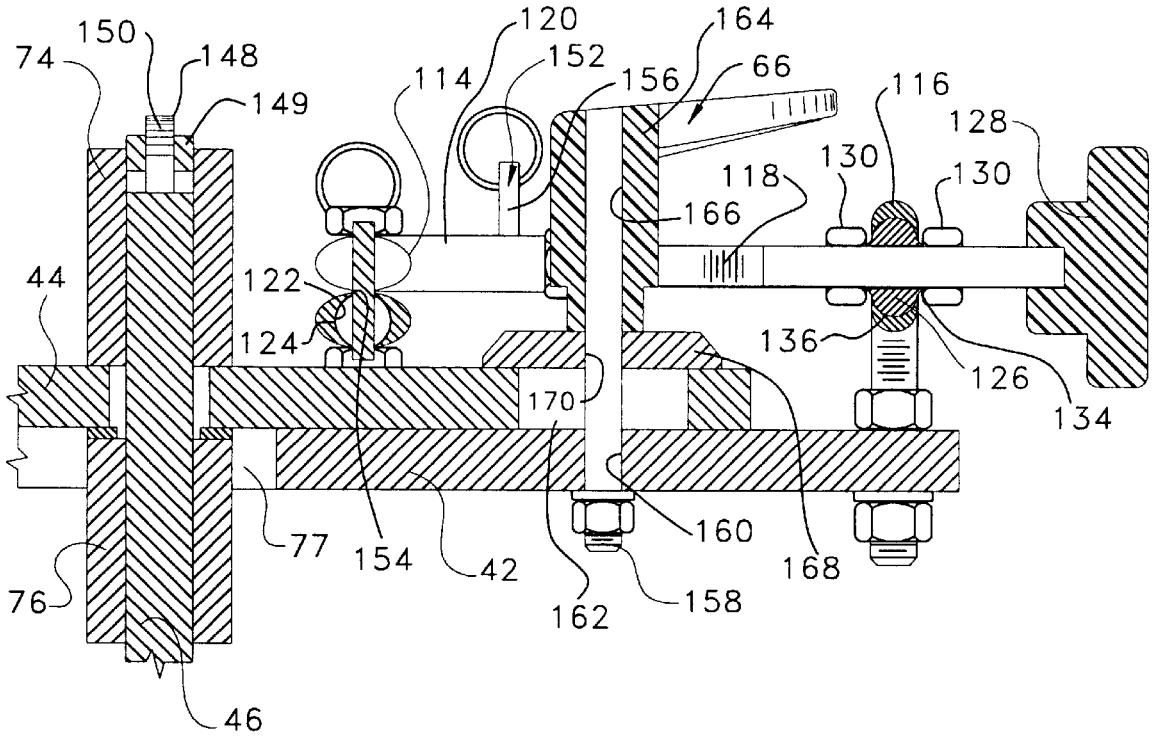
FIG. 9 is a sectional view taken along line 9—9 of FIG. 7.

Depending from the upper slide plate 44 is the pair of threaded bars 46. Each bar 46 depends through a hole 70 in the lower slide plate 42, as seen in FIG. 9 The bars 46 project into engagement with the front "C" shaped channel 22. The "C" shaped channel 22 is adjusted vertically relative to the upper slide plate 44 by the adjustment of a pair of nuts 74 and 76 on each threaded bar 46. The upper nut 74, locate above the upper slide plate 44, and the lower nut 76, located below the upper slide plate 44, hold the threaded bar 46 in a specific position relative to the upper slide plate 44.

Still referring to FIG. 2, the stiffening bar 32, which extends to the shop or plant floor, engages the cantilever end 29 of the arm 28 of the carousel printing machine 12 to minimize flexure of the arm 28. A pair of springs 78 extends from the arm 28 to the "A" shaped support 40 for assisting in holding the front head 10 in a lowered engaged position as shown.

Figure 3:
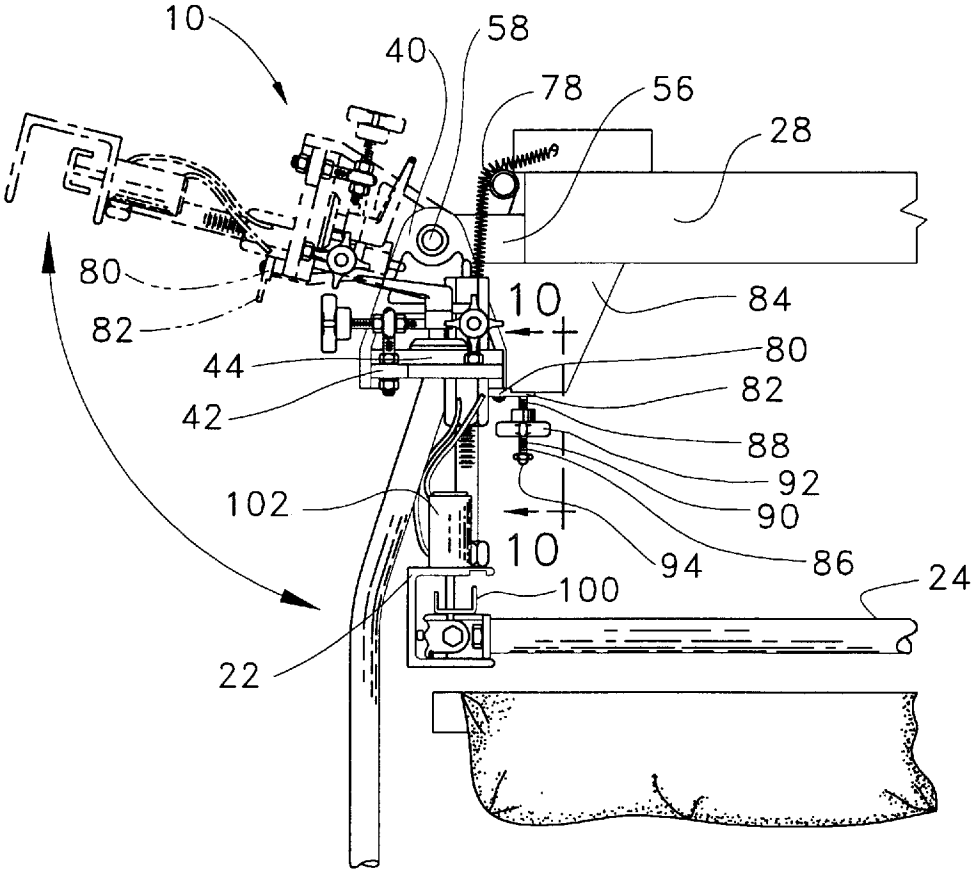
FIG. 3 is a side view of a printing station having the front head according to the invention taken along line 3—3 of FIG. 2. The front head is shown in a raised position in phantom.

Referring to FIG. 3, the front head 10 is shown in the lowered engaged position and in a raised screen installation position in phantom. The pair of springs 78, only one shown in FIG. 3, urge the "A" shaped support 40 both into the engaged position and the raised position.

Mounted to the bottom of the "A" support 40 is an engagement plate 80. The engagement plate 80 has a lip 82. The arm 28, to which the front head 10 is mounted, has a stop 84 which depends downward under the lower projection 56. The lip 82 engages the stop 84 to position the front head 10 in the engaged position. The lip 82 moves upwards as it moves, to the right in FIG. 3, into engagement with the stop 84, because of the relative position of the pivot point (i.e., the bolts 58) of the "A" shaped support 40 relative to the lower projection 56 of the arm 28. The pivot point 58 is located longitudinally outboard, away from the central hub, of the lip 82/stop 84 interface. Therefore, the lip 82 does not engage the stop 84 creating friction until the "A" shaped support 40 is in the lowered engaged position.

Figure 10:
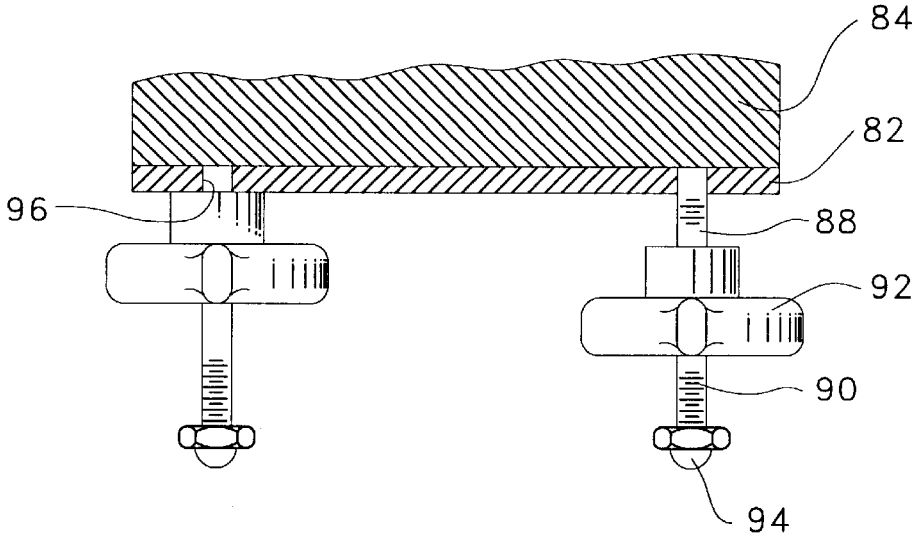
FIG. 10 is a sectional view taken along line 10—10 of FIG. 3.

A pair of shafts 86 extends from the stop 84, mounted to the arm 28. The shafts 86 each have an engagement portion 88 and a threaded portion 90. The threaded portion 90 receives a tightening device such as a knurled knob 92 which is prevented from disengaging the threaded portion 90 by a stop cap 94. The lip 82 of the engagement plate 80 has a pair of slots 96 for receiving the engagement portion 88 of the shaft 86, as seen in FIG. 10. Since the engagement portion 88 of the shaft 86 is not threaded, the entire engagement portion of the shaft 86 engages the slot 96 therein minimizing movement between the parts because there is no lateral movement of the threads.

Figure 10A:
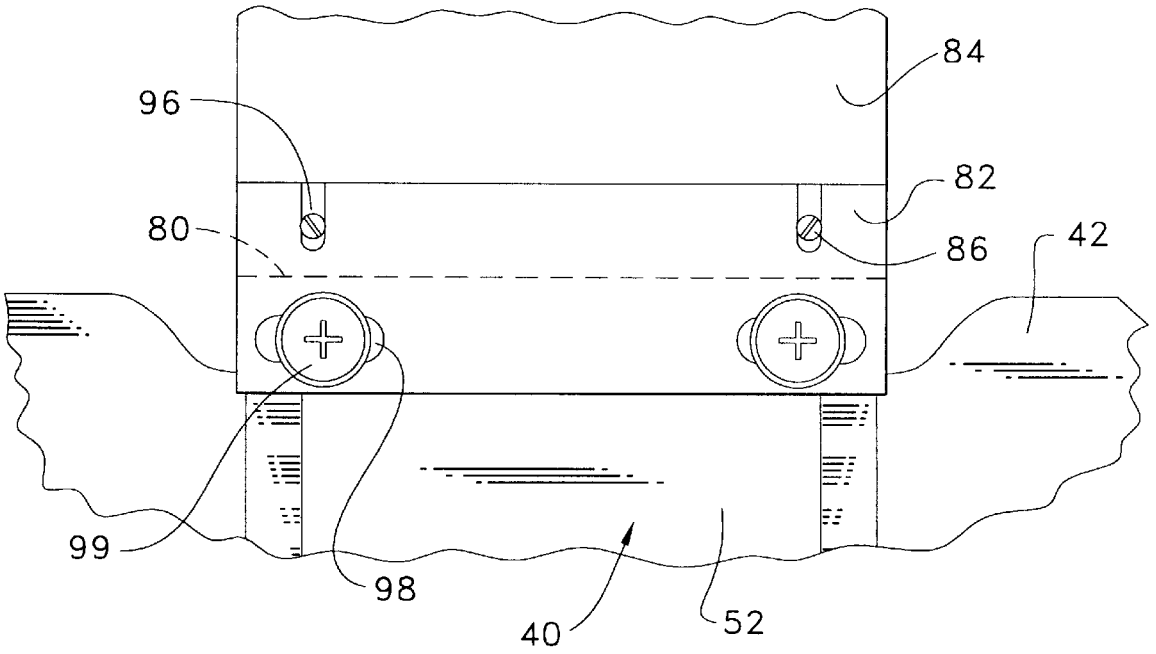
FIG. 10A is a bottom view of the engagement plate.

Referring to FIG. 10A, the engagement plate 80 has a pair of slots 98 to receive a pair of fasteners 99 retained in the stop 84. The fasteners 99 are loosen to allow the engagement plate 80 to be shifted laterally relative to the stop 84 as described in further detail below.

Referring to FIG. 3, the pallet 14 containing a substrate, such as a shirt 16, is supported by the pallet arm 30 which are shown in hidden line. The pallet 14 and arm 30 is shown in a lowered rotation position, therein spacing the screen printing frame 24 from the substrate 16 by a greater distance than would be used for printing.

Figure 4:
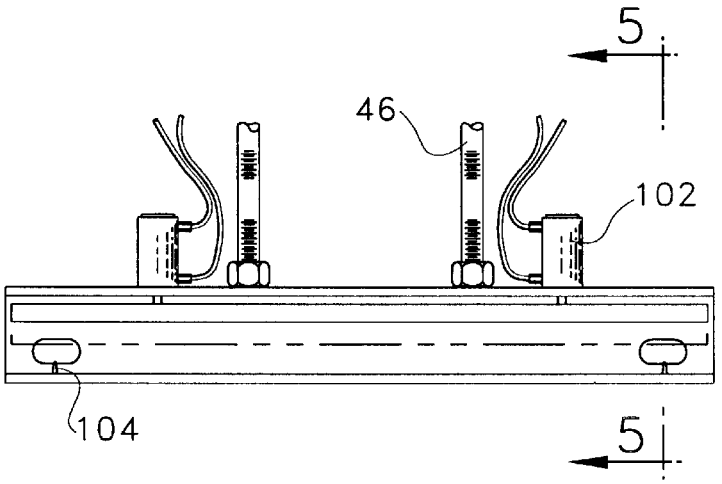
FIG. 4 is a rear elevation of the "C" clamp.
Figure 5:
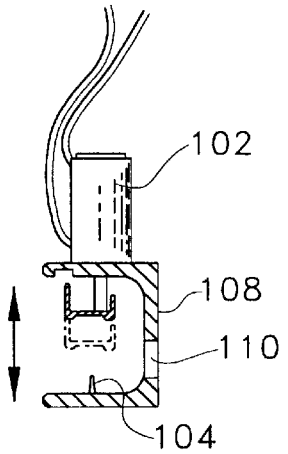
FIG. 5 is a sectional view of the "C" clamp taken along line 4—4 of FIG. 4.

Still referring to FIG. 3, the front "C" shaped channel 22, which extends downward from the threaded bars 46, receives the screen printing frame 24. The "C" shaped channel 22 has a bar 100 which is moved upwards and downwards by a pair of air cylinders 102. The bar 100 in the lowered position engages the screen printing frame 24 to hold it in position. Referring to FIGS. 4 and 5, the "C" shaped channel 22 is shown with the bar 100 in the raised position. The bar 100 is shown in the lowered position in phantom. The "C" shaped channel 22 has a series of pins 104 received by the alignment brackets 106 mounted to the screen printing frame 24 to align the screen printing frame 24 in the "C" shaped channel 22 as disclosed in U.S. Pat. No. 5,377,422 and U.S. patent application Ser. No. 08/347,757 and incorporated herein by reference. The rear "C" shaped channel 20 is similar to the front "C" shaped channel 22 with the exception that the rear "C" shaped channel 20 does not contain the pins. The front "C" shaped channel 22 has a base 108 having a pair of holes 110 for confirming that the screen printing frame 24 is aligned on the pins 104.

Figure 6:
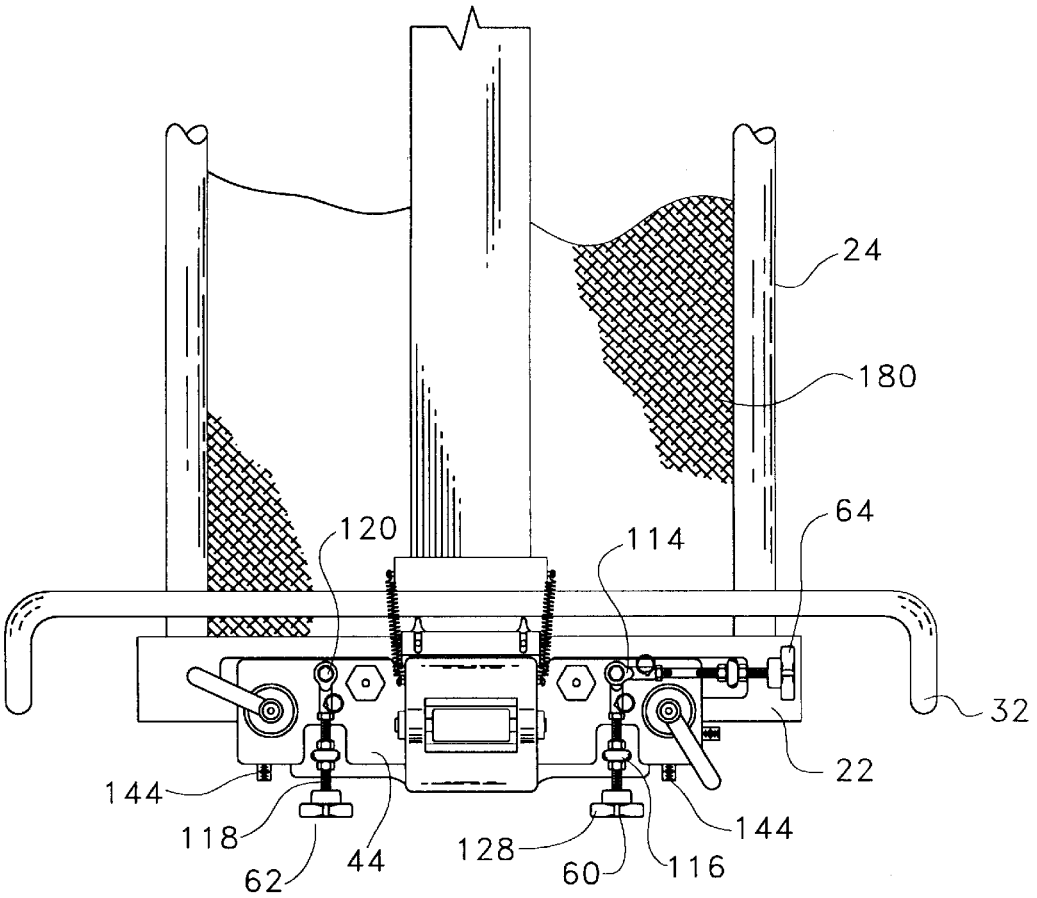
FIG. 6 is a top view of the front head.
Figure 7:
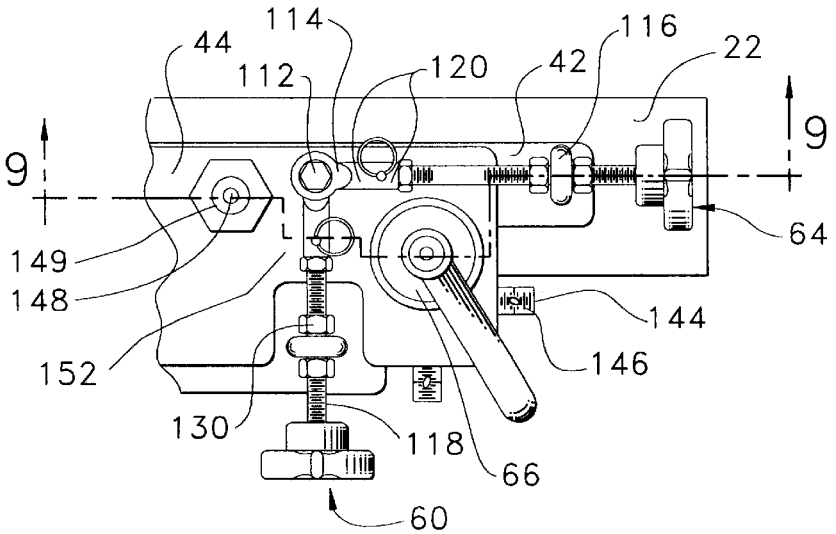
FIG. 7 is a enlarged top view of one end of the front head.
Figure 8:
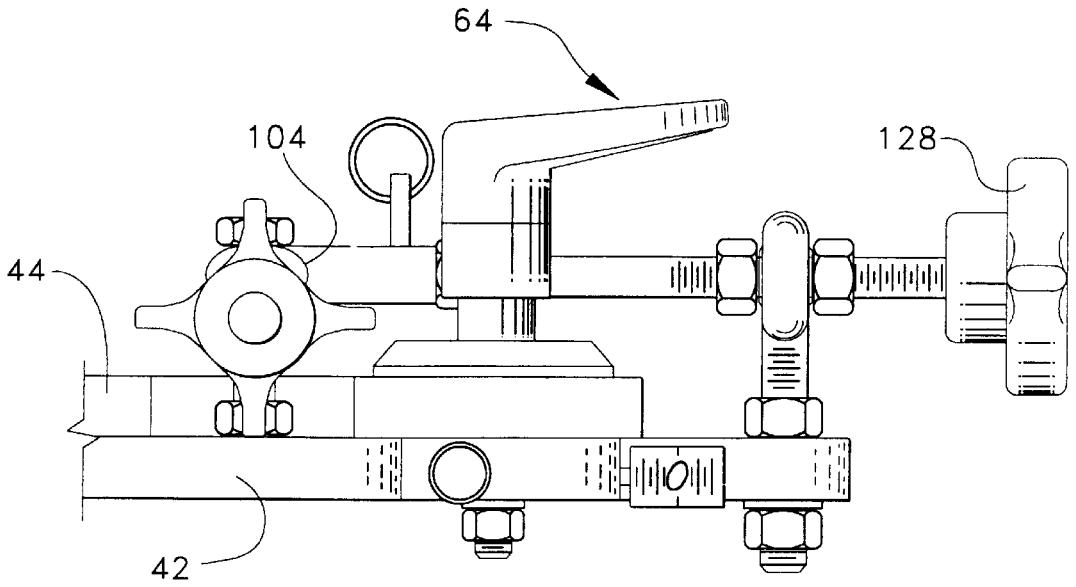
FIG. 8 is a front view of one end of the front head as enlarged from the section indicated with the numeral 8 in FIG. 2.

With the screen printing frame 24 aligned on the pins 104 within the front "C" shaped channel 22, any adjustment required to align the screen printing frame 24 relative to the pallet 14 is done by the front head 10. Referring to FIGS. 6 and 7, the adjustment mechanisms 60, 62, and 64 are generally identical. Each adjustment mechanism consist of an eyebolt 114 pivotably mounted to the upper slide plate 44 (via a fastener such a bolt 112), an eyebolt 116 connected to the lower slide plate 42, and a threaded shaft 118 extending between the eyebolts 114 and 116. Eyebolt 114 has a stem 120 having a bore 122 with internal threads 124, as seen in FIG. 9. The threaded shaft 118 extends from the internal threads 124 of the eyebolt 114 through an eye portion 126 of the second eyebolt 116, as best seen in FIG. 9. The end of the threaded shaft 118 not received by the bore 122, is received by a knurled knob 128.

Referring to FIG. 9, the threaded shaft 118 has a pair of nuts 130 that bracket the eye portion 126 of the second eyebolt 116. The nuts 130 do not allow relative movement between the threaded shaft 118 and the eye portion 126 of the eyebolt 116. The eye portion 126 has a hole 134 which is larger than the threaded shaft 118 and an outer spherical portion 136. Rotation of the knurled knob 128 moves the threaded shaft 118 into or out of the bore 122 of the first eyebolt 114 and therefore moves the eyebolts 114 and 116 relative to each other. Relative movement on the eyebolts 114 and 116 results in relative movement of the sliding plates 42 and 44.

Referring back to FIG. 6, the adjustment mechanism 64 allows for lateral movement of the upper slide plate 44 relative to the lower slide plate 42 and the "A" shaped support 40. The adjustment mechanism 60 allows for in and out movement of the right side of the upper sliding plate 44 relative to the lower sliding plate 42. The adjustment mechanism 62 allows for similar movement of the left hand side, as viewed in FIG. 6.

Still referring to FIGS. 6 and 7, the front head 10 has a plurality of indicators, such as a triplet of calibration gages 144, for determining the relative position of the upper sliding plate 44 to the lower sliding plate 42. Each calibration gage 144 is associated with one of the adjustment mechanisms 60, 62, and 64. Each calibration gage is mounted to the lower sliding plate 42 and has a series of marked increments 146. The operator can compare the edge of the upper sliding plate 44 to the increments 146 of the calibration gage 144 to determine the relative position of the upper sliding plate 44 to the lower sliding plate 42.

Referring to FIGS. 6, 7, and 9, the threaded bars 46 for adjusting the height of the "C" shaped clamp 22 relative to the front head 10 each have a calibration gage 148. The calibration gage 148 is mounted to the top of the threaded bar 46 and is slideably located within a donut or washer 149 mounted with the threaded bore of the upper nut 74. The calibration gage 148 has increments 150 which are read relative to the top of the donut 149.

Referring to FIGS. 7 and 9, the front head 10 has a zero setting device 152 for quickly positioning the screen printing frame 24 relative to the pallet 14 for each of the adjustment mechanism 60, 62 and 64. The zero setting device 152 has a hole 154 extending through the stem 120 of the eyebolt 114. The zero setting device 152 has a pin 156 that is received by the hole 154. The threaded shaft 118 of the adjustment mechanism is rotated such that the threaded shaft 118 is moved out of the bore 122 of the stem 120. With the threaded shaft 118 backed out part-of-the-way from the bore 122, the pin 156 can extend through the hole 154 of the stem 120. The threaded shaft 118 is threaded into the bore 122 into engagement with the pin 156. With the threaded shaft 118 in engagement with the pin 156, the associated (respective) adjustment mechanism 60, 62 or 64 of the front head 10 is said to be in the zero set position.

With all three adjustment mechanisms 60, 62 and 64 in the zero set position, the front head 10 is ready for alignment for the next printing, as described below. The zero set position should be such that none or only minor adjustment is needed to set up for the next printing.

The zero set position is adjustable if it is determined that such zero position is not properly set. The nuts 130 which bracket the second eyebolt 116 are backed away on the threaded shaft 118 from the eye portion 126 of the eyebolt 116. The threaded shaft 118 is backed out of the bore 122, if need be, such that the pin 156 can be placed into the hole 154 of the zero setting device 152. With the pin 156 extended through the hole 154 in the stem 120 of the eyebolt 116, the threaded shaft 118 is threaded into the bore 122 into engagement with the pin 156. The nuts 130 are rotated into contact with the eye portion 126 of the bolt 116. The zero setting devices 152 has been re-zeroed. The re-zeroing or re-calibrating of the zero setting devices 152 associated with each of the adjustment mechanism 60, 62 and 64 is done with the locking mechanism 66, described in detail below, secured such that the sliding plates 42 and 44 do not move relative to each other.

Referring to FIG. 9, the locking mechanisms 66 each have a threaded fastener 158 extending through a threaded hole 160 in the lower sliding plate 42. The threaded fastener 158 extends an enlarged hole 162 in the upper sliding plate 44 to a handle 164 having a threaded bore 166.

Interposed between the handle 164 and the upper sliding plate 44 is a locking plate 168 of sufficient outside diameter to cover the enlarged hole 162 of the upper sliding plate 44 and a hole 170 through which the threaded fastener 158 extends. The handle 164 is rotated on the threaded fastener 158 to move the locking plate 168 into frictional engagement with the upper sliding plate 44 therein moving the upper sliding plate 44 into non-slidable engagement with the lower sliding plate 42. It is recognized that the threaded fastener 158 could be secured to the handle 164 and rotated relative to the threaded hole 160 in the lower sliding plate 42.

In operation

A screen mesh 180 of each screen printing frame 24 is tensioned properly and then the image is properly aligned and adhered to the screen mesh 180. The screen printing frame 24 is placed in the rear "C" shaped channel 20 and the front head 10 is rotated downward from the raised screen installation position to the lowered engaged position. The screen printing frame 24 is positioned in the front "C" shaped channel 22 as the front head 10 is lowered. The front head is secured by the lip 82 of the engagement plate 80 engaging the stop 84. The engagement portion 88 of the shafts 86 are received by the slot 96 and each of the knurled knobs 92 is rotated on the threaded portion 90 into engagement with the lip 82, as seen in FIG. 10.

The alignment brackets 106 of the screen printing frame 24 are located on the pins 104 in the front "C" shaped channel 22 for aligning the screen printing frame 24, and thus the image, with the "C" shaped channel 22. The interaction of the frame to the "C" shaped channel is disclosed in U.S. Pat. No. 5,377,422 and U.S. patent application Ser. No. 08/347,757 and incorporated herein by reference. The bar 100 is lowered by the air cylinder 102 in the front "C" shaped channel 22 to engage and therein secure the screen printing frame 24.

Either prior to the installation of the screen printing frame or after, the adjustment mechanisms 60, 62, and 64 are zeroed out by placing the pin 156 in the hole 154 of each of the zero setting devices 152 and threading the threaded shaft 118 into the bore 122 into engagement with the pin 156. The locking mechanisms 66 are tightened to prevent movement between the sliding plates 42 and 44. The pin is removed from each of the zero setting devices 152. The bar 100 is lowered by the air cylinder 102 in the rear "C" shaped channel 20 to secure the screen printing frame 24. The images on each screen mesh 180 should be properly aligned to the pallet 14 such that the image from the multiple screen printing frames 24 will align properly on the substrate 16, such as a shirt, when the carousel printing machine 12 operates.

However, if the images are not properly aligned, the operator after accomplishing a test print determines what images of the multiple screen printing frames 24 needs to be shifted. On those images to be shifted, the bar 100 is raised by the air cylinder in the rear "C" shaped channel to allow for adjustment of the screen printing frame. The screen printing frame is not moved relative to the front "C" shaped channel 22, where it is located by pins 104 and therefore the bar 100 on the front "C" shaped channel 22 need not and should not be raised.

The operator loosens the locking mechanisms 66 by rotating the handle 64, therein allowing the upper sliding plate 44 to move relative to the lower sliding plate 42 and the locking plate 168. The appropriate adjustment mechanism 60, 62 or 64 is rotated to move the screen printing frame 24 either translationally (perpendicular to the arm 28) or longitudinal (towards or away from the central hub as described in this embodiment), or both as required. The movement of one of the adjustment mechanisms 60 or 62 without the same movement of the other will result in a yaw movement (rotation about a line perpendicular to the plane of screen mesh) of the screen printing frame 24, which may or may not be desired. The locking mechanisms 66 are then re-tighten.

If it is determined that the screen printing frame needs to be raised or lowered, one of the nuts, either the upper nut 74 or the lower nut 76 is backed away on the threaded bar 46 from the upper sliding plate 44; the upper nut 74 if the "C" shaped channel 22 is to be raised and the lower nut 76 if the "C" shaped channel 22 is to be lowered. The other nut 74 or 76 is rotated to achieve the proper position of the "C" shaped channel 22. Then the first nut 74 or 76 is rotated back into position. With the nuts 74 and 76 firmly engaging the upper sliding plate 44, the calibration gage 148 can be read. In addition to the vertical movement, roll and pitch of the screen printing frame 24 can be adjusted by adjusting the threaded bars 46 relative to each other or the rear "C" shaped channel 20.

In addition, the front head 10 can be shifted relative to the lower projection 56 of the arm 28 of the printing machine 12. Referring to FIGS. 2 and 6, the projection 56 can be shifted in the groove 50 of the "A" shaped support 40. Referring to FIG. 10A, the engagement plate 80 likewise has to be shifted relative to the "A" shaped support 40 such that the engagement portions 88 of the shaft 86 is received by the slots in the engagement plate 88.

In that the printing machine 12 is circular, the pallet 14 and printing stations 18 are segments around the central hub 26. If the front head 10 is not aligned with the pallet 14 below, the "A" shaped support 40 can be shifted as described above.

Alternative embodiment

Figure 12:
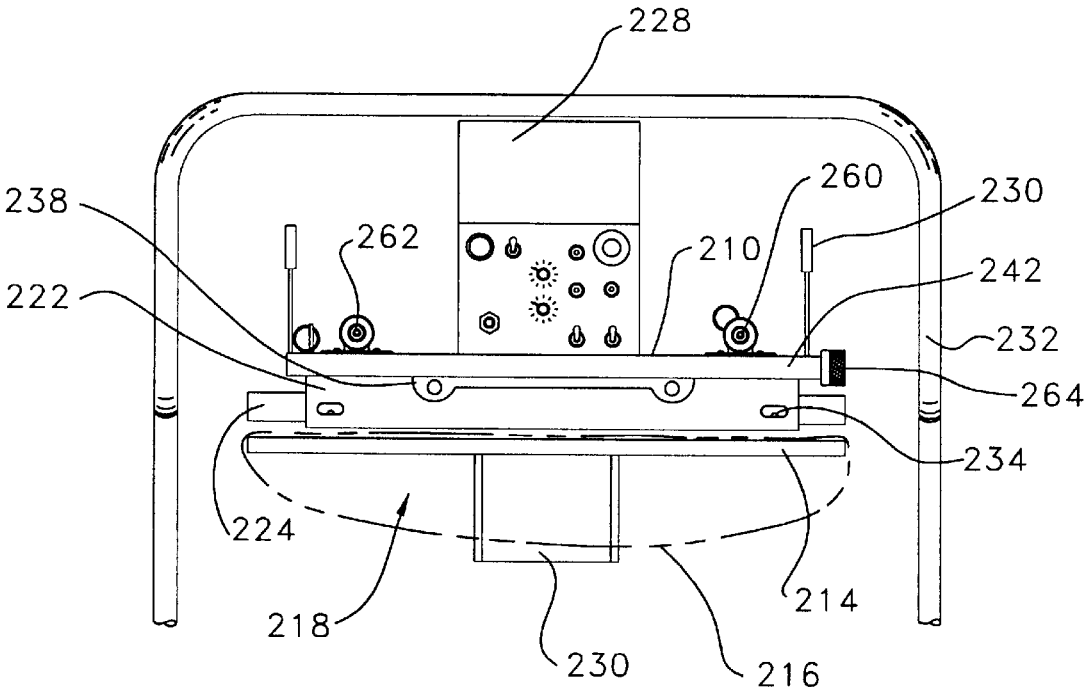
FIG. 12 is a front view of the alternative embodiment of the front head.

Referring to FIG. 12, an alternative front head 210 for a different carousel printing machine 212 is shown. The carousel printing machine 212 similar to the first embodiment has a plurality of pallets 214, each for receiving a substrate 216, such as a shirt shown in phantom, to be printed on, and a plurality of print stations 218.

Similar to the first embodiment, each of the printing stations has an identical front head 210, thus only one is shown and will be discussed. The printing machine 212 has an arm 228 and a pair of side bars 230 for supporting the front head 210 of the print station 218. The pair of side bars 230 support the back head, not shown, of the print station 218. Similarly to the print machine of the first embodiment, the front head 210 has a front "C" shaped channel 222 for receiving the screen printing frame 224 which depends from the front head 210. The carousel printing machine 212 has stiffening bars 232 which support the arm 228.

Figure 11:
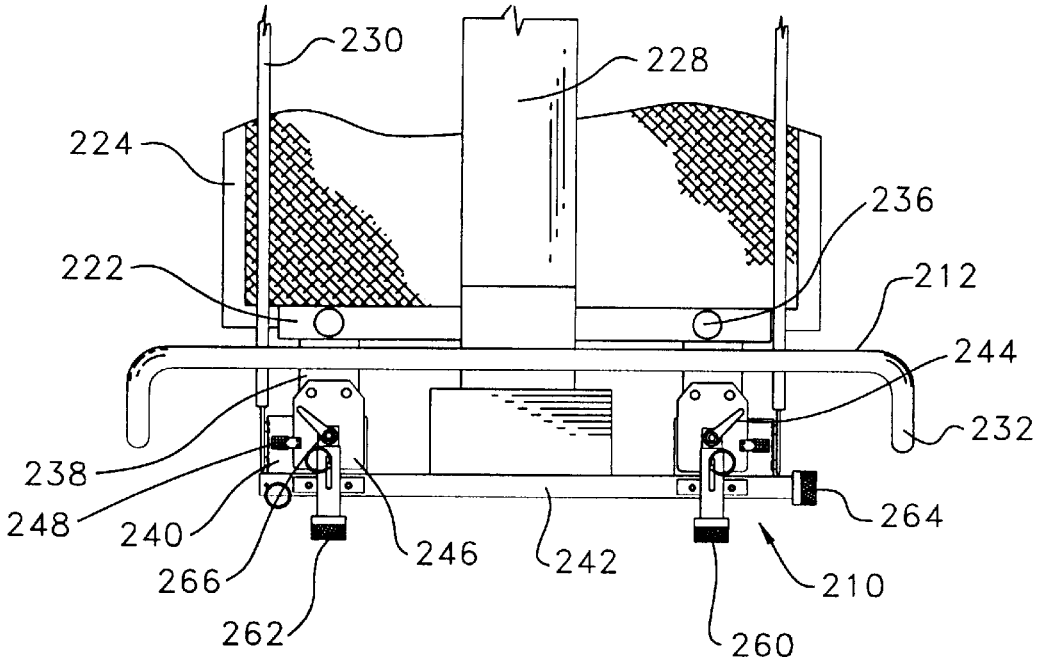
FIG. 11 is a top view of an alternative machine having an alternative embodiment of the front head.

The "C" shaped channel 222 has a pair of pins 234 for registration of the screen printing frame 224, a bar, not shown, and a pair of air cylinders 236, as seen in FIG. 11, for moving the bar between a lowered screen engaging position and a raised install position. The "C" shaped channel 222 has a mounting bracket 238.

The pallet 214 holding a substrate 216, such as a shirt, is supported by the pallet arm 230. The pallet 214 and arm 230 are shown in a lowered rotation position, therein spacing the screen printing frame 224 from the substrate 216 by a greater distance than would be used for printing. In contrast to the first embodiment, while the pallet 214 rotates from station to stations, it is the print station that moves upward and downward in the carousel printing machine 212 described in this embodiment.

Referring to FIG. 11, the front head 210 has a pair of mounting plates 240. Each of the mounting plates 240 is secured to one of the side bars 230. The front head 210 has a transverse bar 242 which extends between and beyond the mounting plates 240. The transverse bar 242 is secured to the mounting plates 240. The front head 210 has a triplet of adjustment mechanisms 260, 262, and 264. Each of the adjustment mechanism 260 and 262 span between the transverse bar 242 and a slideable plate 244 and 246. In contrast to the first embodiment, these two distinct slideable plates are not linked by the adjustment mechanism.

The third adjustment mechanism 264 allows for transverse movement of the slideable plates 244 and 246. The third adjustment mechanism 264 moves both adjustment mechanism 260 and 262 together in the transverse direction relative to the transverse bar 242, as described below.

In addition, there are a pair of locking mechanisms 266 for securing the slidable plates 244 and 246 in relative position to the mounting plates 240. The front head 210 has a pair of calibration gages 248, each for determining the relative position of the sliding plate (244 and 246) to the respective mounting plate 240, which is secured to the transverse bar 242. Each of the calibration gage 248 has an indicator plate 250 located on the mounting plate 240 and a pointer 252 on the respective sliding plate 244, 246. Each calibration gage 248 is associated with one of the adjustment mechanisms 260 and 262.

Figure 13:
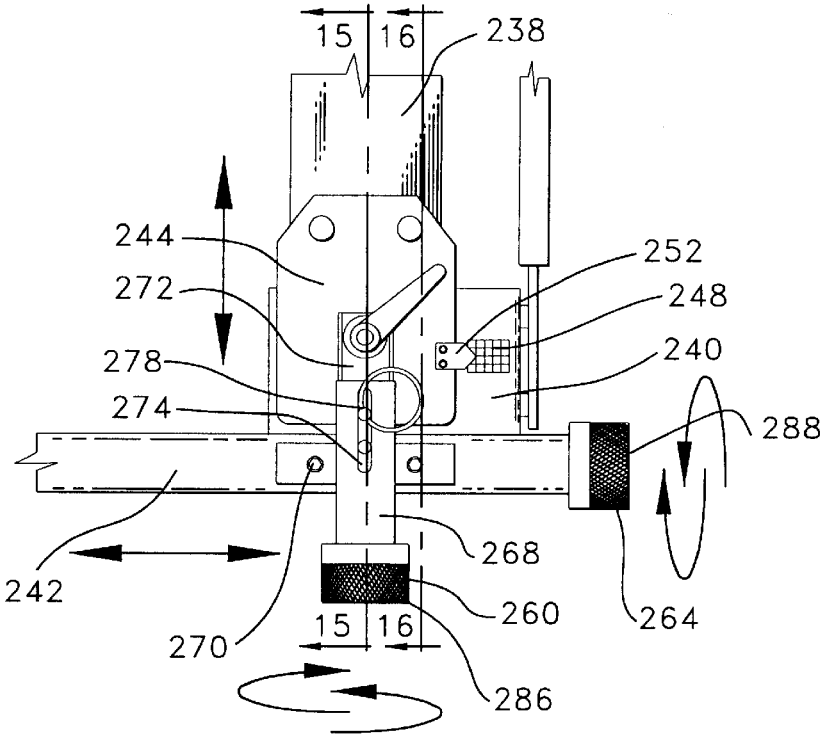
FIG. 13 is an enlarged top view of one end of the alternative embodiment of the front head.
Figure 14:
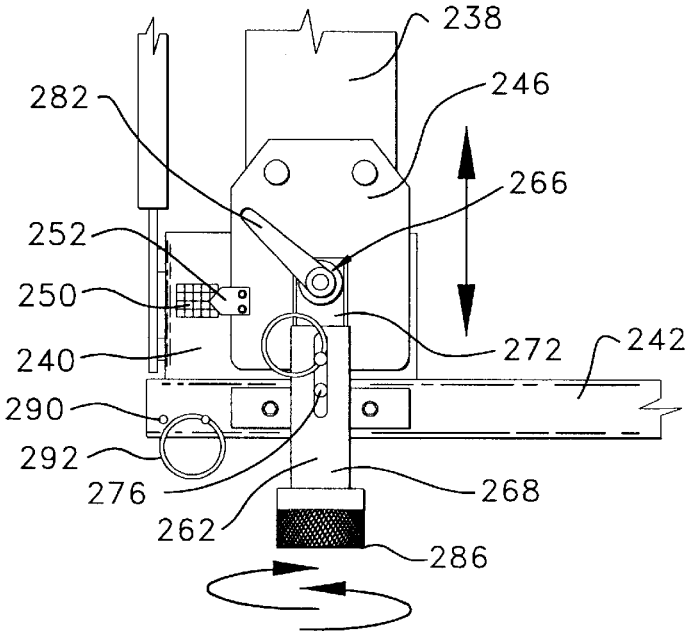
FIG. 14 is an enlarged top view of the other end of the alternative embodiment of the front head.
Figure 15:
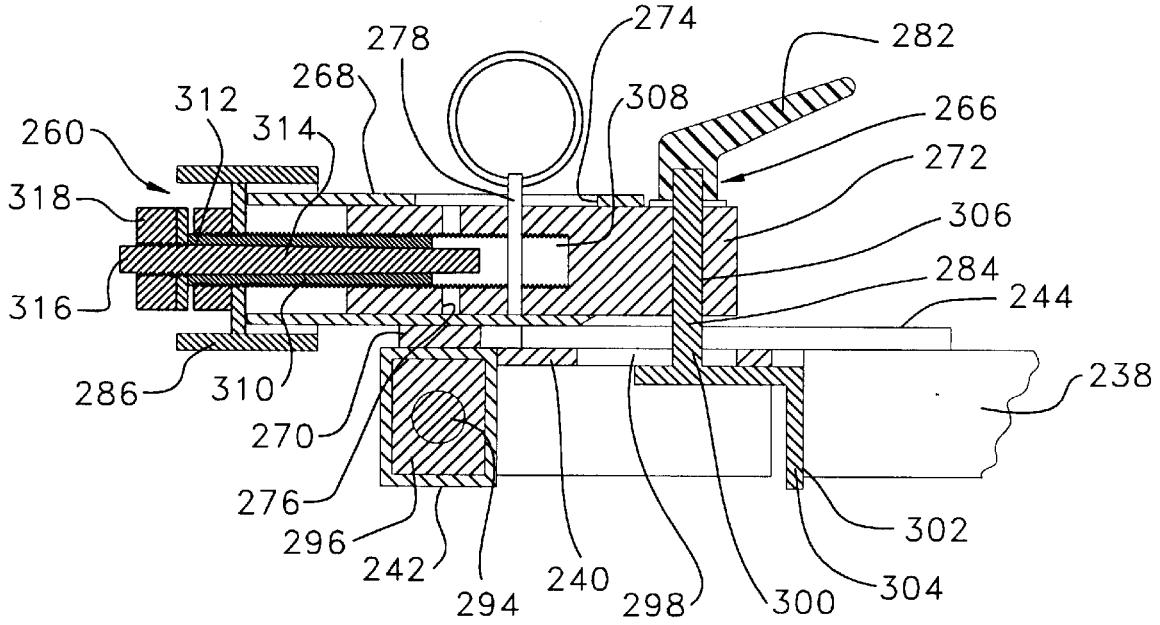
FIG. 15 is a sectional view taken along line 15—15 of FIG. 13.

Referring to FIGS. 13 and 14, each of the adjustment mechanism 260 and 262 has a sleeve 268 carried by the transverse bar 242 with an interposed mounting strip 270. The sleeve 268 moves in the transverse direction relative to the transverse bar 242 as discussed below relative to FIGS. 15 and 16. A slideable square bushing 272 is located in each sleeve 268. The sleeve 268 has a slot 274 granting access to a pair of holes 276 located in the bushing 272 adapted for receiving a pin 278. The pin 278 is part of a re-zeroable zero device 280, as described below. At the end of the bushing 272, projecting out of the sleeve 268, is located a handle 282, part of the locking mechanism 266, for engaging a threaded shaft 284 as seen in FIG. 15. Encircling the end of the sleeve 268 which the bushing does not extend, is a knob 286.

The third adjustment mechanism 264 has a knob 288 located at one end of the transverse bar 242 (as seen in FIG. 13) and a pair of holes 290 for receiving a pin 292 at the other end (as seen in FIG. 14). The third adjustment mechanism 264 has a threaded rod 294 extending longitudinally within the transverse bar 242, as seen in FIG. 15. The third adjustment mechanism 264 has a sliding square bushing 296. The sliding square bushing 296 extends within the transverse bar 242 between the adjustment mechanisms 260 and 262 and is moved by rotation of the threaded rod 294, which is rotated by the knob 288.

Referring to FIG. 15, the mounting bracket 238 secured to the "C" shaped channel 222, is mounted to the two distinct sliding plates, only one shown 244, of the front head 210. Each of the sliding plates 244 is located above one of the mounting plates 240. The mounting plate 240 has a rectangular slot 298. The sliding plate 244 has a hole 300, which is position above the rectangular slot 298 of the mounting plate 240.

The front head 210 has a pair of "L" shaped brackets 302. Each "L" shaped bracket 302 is associated with one of the sliding plates 244 and 246. The "L" shaped bracket 302 has a base 304 which is secured to the mounting bracket 238 associated with the "C" shaped channel 222.

The threaded shaft 284 associated with the locking mechanism 266 projects upward from and is integral with the "L" shaped bracket 302. The threaded shaft 284 extends through the slot 298 in the mounting plate 240 and the hole 300 in the sliding plate 244. In addition, the threaded shaft 294 extends through a hole 306 at the end of the bushing 272 projecting out of the sleeve 268. The threaded shaft 284 moves both translationally (along the length of the transverse bar) and longitudinally (towards and away from the center of the printing machine) with the sliding plate 244 and therefore is part of both the adjustment mechanism 260 and the locking mechanism 266.

Still referring to FIG. 15, the slideable square bushing 272 located in the sleeve 268 has a threaded bore 308. The adjustment mechanism 260 has a threaded shaft 310 secured to the knob 286 by a lock nut 312 and extending into the threaded bore 308 in the slideable bushing 272. The threaded shaft 310 has a threaded bore 314. The threaded bore 314 receives a threaded inner stud 316. The threaded inner stud 316 is held in position relative to the outer threaded shaft 310 by a second lock nut 318. The two holes 276 in the bushing 272 and extend through the bore 308 are adapted to receive the pin 278.

The first and second adjustment mechanisms each have an identical re-zeroable zero or re-calibration zero device 280. The zeroing of the front head 210 allows for quickly positioning the screen printing frame 224 relative to the pallet 214 for each of the first and second adjustment mechanism 260 and 262. The threaded shaft 310 of the adjustment mechanism 260 is rotated by rotating the knob 286 such that the threaded shaft 310 and the threaded inner stud 316 is rotated out of the threaded bore 308 of the slideable square bushing 272. With the threaded inner stud 316 backed out part way from the threaded bore 308, the pin 278 can extend through either of the holes 276 of the slideable bushing 272. The hole 276 is chosen dependent on which is considered the zero position. The threaded shaft 310 is threaded into the bore 308 until the threaded inner stud 316 engages the pin 278. With the threaded inner stud 316 in engagement with the pin 278, the associated (respective) adjustment mechanism of the front head 210 is said to be in the zero set position.

To re-position, re-calibrate, the zero device 280, the lock mechanism 266 is secured with the screen printing frame 224 in the proper position. The lock nut 318 associated with the threaded inner stud 316 is loosened and the threaded inner stud 316 is rotated back such that the pin 278 can be inserted in the hole 276. The threaded inner stud 316 is rotated back so that its end engages the pin 278 inserted in the hole 276. The lock nut 318 is tighten, therein re-calibrating, re-zeroing, the zero device 280.

Figure 16:
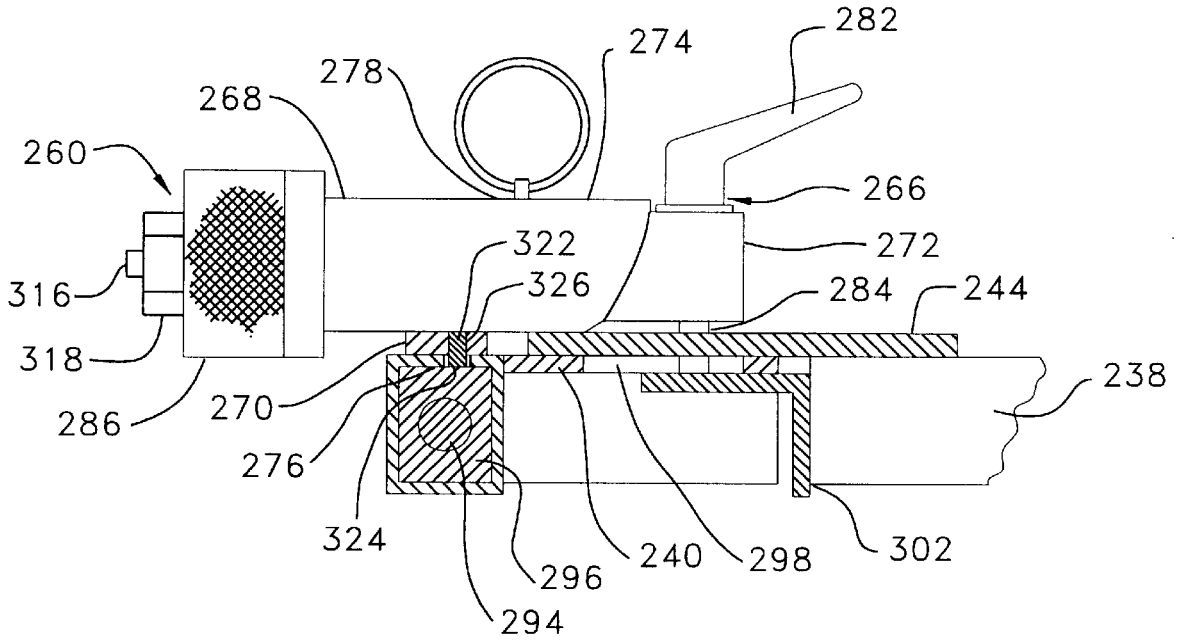
FIG. 16 is a sectional view taken along line 16—16 of FIG. 13.

Referring to FIGS. 15 and 16, the third adjustment mechanism 264 has the slidable square bushing 296 which moves along the threaded rod 294 in the transverse bar 242. The slideable bushing 296 has a series of shafts 322, only one seen in FIG. 16. Each shaft 322 projects upward through a slot 324 in the transverse bar 242 into a hole 326 in the mounting strip 270 and is peened over, as best seen in FIGS. 13 and 14. The mounting strip 270 and the first and second adjustment mechanisms 260 and 264 move with the slideable bushing 296 of the third adjustment mechanism 264. The third adjustment mechanism 264, similar to that in the first embodiment, moves the "C" shaped channel 222 and the screen printing frame 224 in the transverse direction.

Figure 17:
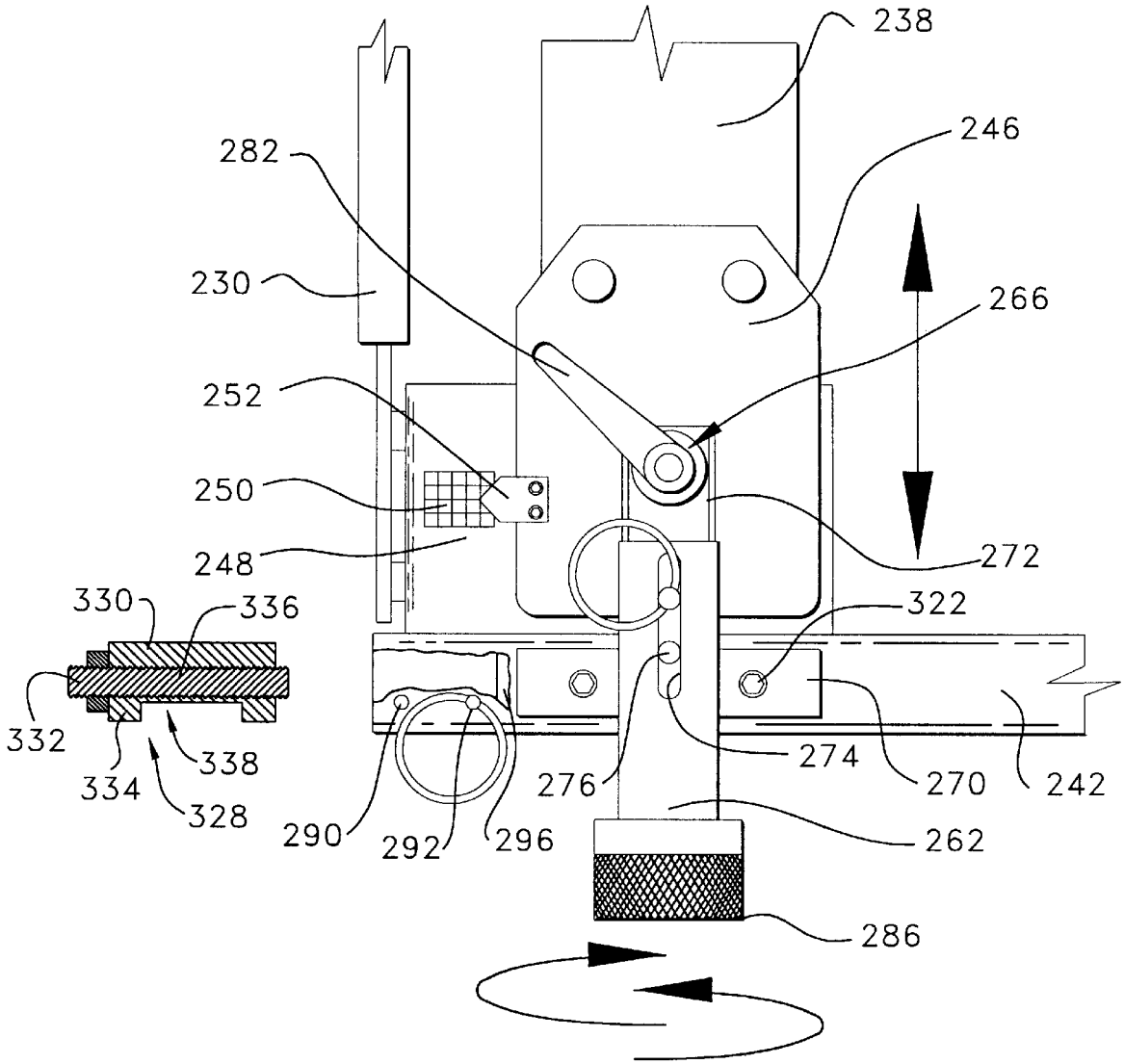

Referring to FIG. 17, the third adjustment mechanism 264 has a re-zeroable zero or re-calibration zero device 328. The zeroing of the front head 210 allows for quickly positioning in the transverse direction the screen printing frame 224 relative to the pallet 214. The zero device 328 is shown in cross section and has a block 330, a threaded shaft 332 and a lock nut 334. The block 330 has a threaded bore 336 and a pin receiving channel 338. The threaded shaft 332 is located in the threaded bore 336 of the block 330 and is positioned by the lock nut 334.

To position the third adjustment mechanism 264 at the zero position, the knob 288, as seen in FIG. 13, is rotated to move the slideable square bushing 296, seen in the broken out section of the transverse bar 242, toward the knob 288 and away from the holes 290 for the pin 292. The zero device 328 is inserted into the transverse bar 242. The pin 292 is inserted into one of the holes 290 such that it extends through the pin receiving channel 338 of the block 330 of the zero device 328. The slideable square bushing 296 is moved back by rotation of the knob 288 and the threaded rod 294 until the slideable square bushing 296 engages the threaded shaft 332 of the zero device 328. In that the adjustment mechanism 260 and 262 and associated slideable plate 244 and 246 move with the bushing 296 the screen printing frame 224 is positioned in the transverse direction relative to the pallet 214.

Still referring to FIG. 17, to re-position, re-calibrate, the zero device 328, the lock mechanisms 266 is secured with the screen printing frame 224 in the proper position. The lock nut 334 is loosened from engaging the block 330 such that the threaded shaft 332 can rotate within the threaded bore 336. The zero device 328 is inserted into the transverse bar 242 with the threaded shaft 332 engaging the end of the bushing 296. The threaded shaft 332 is rotated relative to the block 300 until the pin 292 can be inserted into one of the holes 290, therein defining the zero position. The lock nut 334 is rotated into position engaging the block 330 therein re-calibrating the zero device 328.

The present invention may be embodied in other specific forms without departing from the spirit or essential attributes thereof and, accordingly, reference should be made to the appended claims, rather than to the foregoing specification, as indicating the scope of the invention.

We claim:

1. An apparatus for securing a screen printing frame to a printing machine, the apparatus comprising:

a retainer for holding the screen printing frame;

a mounting head carried by the printing machine;

a plurality of first adjustment means interposed between the mounting head and the retainer for adjusting the retainer and the screen printing frame relative to the mounting head; and at least one of the first adjustment means having a stop for locating a zero position of the first adjustment means.

2. An apparatus for securing a screen printing frame to a printing machine as in claim 1, further comprising a second adjustment means for adjusting the stop to adjust the zero position of the first adjustment means.

3. An apparatus for securing a screen printing frame to a printing machine as in claim 1, wherein the retainer comprises a "C" shaped clamp for receiving the screen printing frame; and wherein at least one of the first adjustment means has a sleeve having a threaded bore carried by either the retainer or the mounting head and a threaded shaft carried by the other of the retainer or the mounting head wherein rotation of the threaded shaft in the threaded bore adjusts the position of the screen printing frame relative to the mounting head.

4. An apparatus for securing a screen printing frame to a printing machine as in claim 3, wherein the stop comprises a hole extending through the threaded bore and a pin for insertion into the hole for locating an end of the threaded shaft within the threaded bore.

5. An apparatus for securing a screen printing frame to a printing machine as in claim 4, wherein the threaded shaft is adjustably positioned on the other of the screen printing frame retaining means or the mounting head for adjusting the stop and thereby adjusting the zero position of the first adjustment means.

6. An apparatus for securing a screen printing frame in a printing machine comprising:

a beam extending along a longitudinal axis;

a mounting head located at an end of the beam, the mounting head having a channel for receiving the screen printing frame;

the mounting head having a frame, the frame having an apex and a base, the apex of the frame being pivotably mounted to the beam for pivoting the mounting head between an open raised position in which the channel is retracted from the screen printing frame and a closed lowered position in which the channel is engageable with the screen printing frame;

a retainer for securing the frame in the lowered position;

a first plate carried by the base of the frame;

a second plate slideably located on the first plate;

a plurality of adjustment mechanisms for adjustably moving the second plate relative to the first plate; and the channel being carried by the second plate.

7. An apparatus for securing a screen printing frame in a printing machine as in claim 6 wherein the channel comprises a registration means for aligning the screen printing frames and a clamp for securing the screen printing frame in the channel.

8. An apparatus for securing a screen printing frame in a printing machine as in claim 7, wherein the head further comprises an engagement plate mounted to the base of the frame, the engagement plate having a lip for engaging a stop on the mounting head when the frame is in a lowered position, the engagement plate is slideably mounted to the frame for allowing translational movement of the frame relative to the beam.

9. An apparatus for securing a screen printing frame in a printing machine as in claim 7 further comprising a pair of vertical adjustment means interposed between the second plate and the channel for moving the channel in vertical and roll directions relative to the frame.

10. An apparatus for securing a screen printing frame in a printing machine as in claim 7 further comprising a holder for retaining the frame in the open raised position and in the closed lowered position.

11. An apparatus for securing a screen printing frame in a printing machine as in claim 10, wherein the holder is a pair of springs extending between the beam and the frame.

12. An apparatus for securing a screen printing frame in a printing machine as in claim 7, wherein at least one of the adjustment mechanisms has a sleeve having a threaded bore carried by either the retainer or the mounting head and a threaded shaft carried by the other of the retainer or the mounting head and wherein rotation of the threaded shaft in the threaded bore adjusts the position of the screen printing frame relative to the mounting head.

13. An apparatus for securing a screen printing frame to a printing machine as in claim 12, wherein the at least one adjustment mechanism further comprises a stop, the stop having a hole extending through the threaded bore and a pin for insertion into the hole for locating an end of the threaded shaft within the threaded bore.

14. An apparatus for securing a screen printing frame to a printing machine as in claim 13, wherein the threaded shaft is adjustable positioned on the other of the retainer or the mounting head for adjusting the stop and thereby adjusting the zero position of the adjustment mechanism.

15. An apparatus as in claim 7, further comprising a position indicator mounted on one of the plates for indicating the relative position of the other plate.

16. An apparatus for securing a screen printing frame in a printing machine as in claim 6, wherein the head further comprises an engagement plate mounted to the base of the frame, the engagement plate having a lip for engaging a stop on the mounting head when the frame is in a lowered position.

17. An apparatus as in claim 16, wherein the retainer comprises a slot carried by the lip or the stop and a shaft extending from the other of the lip or the stop, the slot adapted to receive the shaft, the shaft be received by the slot and having a threaded portion adapted to receive a tightening device, the tightening device being movable on the shaft to retain the mounting head in the closed lowered position.

18. An apparatus for securing a screen printing frame in a printing machine as in claim 17 wherein the slot is carried by the lip and the shaft is carried by the stop and the tightening device is a knob movable on the shaft for engaging the lip to retain the head in the closed lowered position.

19. An apparatus for securing a screen printing frame in a printing machine as in claim 17 wherein the frame further comprises a groove at the apex and wherein the engagement plate is slideably mounted to the base of the frame for adjusting the frame laterally relative to the beam and the stop.

20. An apparatus for securing a screen printing frame in a printing machine as in claim 16, wherein the apex is positioned relative to the engagement lip such that the engagement lip is rotated upward into engagement with the stop.

21. An apparatus for securing a screen printing frame in a printing machine as in claim 6 wherein the frame is movable relative to the beam.

22. An apparatus for securing a screen printing frame in a printing machine comprising:

a retainer for holding the screen printing frame;

a mounting head carried by the printing machine;

a pair of slidable plates carrying the retainer;

a pair of first adjustment mechanisms, each first adjustment mechanism being interposed between the mounting head and one of the slidable plates for moving the one slidable plate and the retainer relative to the mounting head;

a second adjustment mechanism interposed between the pair of first adjustment mechanisms and the mounting head for moving the pair of first adjustment mechanisms and the pair of slidable plates relative to the mounting head;

at least one of the first adjustment mechanisms having a stop for locating a zero position for the first adjustment mechanisms.

23. An apparatus for securing a screen printing frame to a printing machine as in claim 22 further comprising a third adjustment mechanism for adjusting the stop zero position of the first adjustment means.

24. An apparatus for securing a screen printing frame to a printing machine as in claim 23, further comprising at least one calibration gage having an indicator plate and a pointer adapted for showing relative movement of one of the slidable plates relative to the mounting head.

25. An apparatus for securing a screen printing frame in a printing machine comprising:

a beam extending along a longitudinal axis;

a mounting head located at an end of the beam, the mounting head having a channel for receiving the screen printing frame;

the mounting head having a frame, the frame having an apex and a base, apex of the frame being pivotably mounted to the beam for pivoting the head between an open raised position in which the channel is retracted from the screen printing machine and a closed lowered position in which the channel is engageable with the screen printing frame;

a retainer for securing the frame in the lowered position;

a first plate carried by the base of the frame;

a second plate slideably located on the first plate;

a plurality of adjustment mechanisms for adjustably moving the second plate relative to the first plate, a first adjustment mechanism and a second adjustment mechanism being generally parallel to each other and capable of moving the second plate in the longitudinal and yaw directions relative to the first plate, a third adjustment mechanism being generally perpendicular to the first and second adjustment mechanisms for moving the second plate in the lateral direction relative to the first plate;

at least one of the adjustment mechanisms having a zero setting means for setting the relative positions of the plates to a designated zero position; and a channel carried by the second plate for receiving the screen printing frame.

26. An apparatus for securing a screen printing frame in a printing machine as in claim 25 further comprising a fourth adjustment mechanism for adjusting the zero setting means and thereby adjusting the zero position of the at least one adjustment mechanism.

27. An apparatus for securing a screen printing frame to a printing machine as in claim 26, wherein the channel comprises a "C" shaped clamp for receiving the screen printing frame; and wherein at least one of the adjustment mechanisms has a sleeve having a threaded bore carried by either the retainer or the mounting head and a threaded shaft carried by the other of the retainer or the mounting head wherein rotation of the threaded shaft in the threaded bore adjusts the position of the screen printing frame relative to the mounting head.

28. An apparatus for securing a screen printing frame to a printing machine as in claim 27, wherein the zero setting means further comprises a hole extending through the threaded bore and a pin for insertion in the hole for locating an end of the threaded shaft within the threaded bore.

29. A method of aligning a screen printing frame carrying an image in a printing machine comprising the following steps:

placing the screen printing frame in a rear "C" shaped channel of the printing machine;

rotating a front mounting head of the printing machine to a lowered engaged position;

placing the screen printing frame in a front "C" shaped channel of the front mounting head;

securing the front mounting head to a stop;

positioning the screen printing frame in the front "C" shaped channel using alignment means;

securing the screen printing frame in the front "C" shaped channel;

zeroing a plurality of adjustment mechanisms interposed between a pair of sliding plates on the front mounting head;

preventing relative movement between the sliding plates by tightening a plurality of lock mechanisms on the front mounting head;

securing the screen printing frame in the rear "C" shaped channel;

checking the alignment of images carried by the screen printing frame; and realigning if necessary by detaching the screen printing frame from the rear "C" shaped channel;

loosening the plurality of lock mechanisms;

adjusting at least one of the adjustment mechanisms;

re-tightening the plurality of lock mechanism; and securing the screen printing frame in the rear "C" shaped channel.

30. A method of aligning a screen printing frame carrying an image in a printing machine as in claim 29 wherein securing the front mounting head to a stop step comprises the following steps:

engaging a lip of an engagement plate carried by the front mounting head to the stop and a receiving shafts carried by the stop in slots of the engagement plate; and rotating tightening devices carried by the shaft into engagement with the lip.

31. A method of aligning a screen printing frame carrying an image in a printing machine as in claim 29 wherein the zeroing of the adjustment mechanism step occurs prior to the placing of the screen printing frame in the front "C" shaped channel of the front mounting head step.

* * * * *